US007017318B1

(12) United States Patent
Hohmann et al.

(10) Patent No.: US 7,017,318 B1
(45) Date of Patent: Mar. 28, 2006

(54) HIGH-SPAN ANCHORING SYSTEM FOR CAVITY WALLS

(75) Inventors: Ronald P. Hohmann, Hauppauge, NY (US); Ronald P. Hohmann, Jr., Hauppauge, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 49 days.

(21) Appl. No.: 10/188,536

(22) Filed: Jul. 3, 2002

(51) Int. Cl.
*E04B 2/30* (2006.01)

(52) U.S. Cl. ..... 52/562; 52/713; 52/379; 52/426

(58) Field of Classification Search ..... 52/378–379, 52/383, 426, 428, 562, 565, 712–714, 647, 52/649.1; 405/284, 286; 211/106, 181.1
See application file for complete search history.

(56) References Cited

U.S. PATENT DOCUMENTS

| | | | | | |
|---|---|---|---|---|---|
| 1,170,419 | A | * | 2/1916 | Coon et al. | 52/426 |
| 1,282,090 | A | * | 10/1918 | Lemme | 52/592.4 |
| 3,277,626 | A | * | 10/1966 | Brynjolfsson et al. | 52/713 |
| 3,300,939 | A | * | 1/1967 | Brynjolfsson et al. | 52/713 |
| 3,342,004 | A | * | 9/1967 | Lucas | 52/695 |
| 3,377,764 | A | | 4/1968 | Storch | 52/426 |
| 3,964,226 | A | * | 6/1976 | Hala et al. | 52/562 |
| 4,021,990 | A | | 5/1977 | Schwalberg | 52/714 |
| 4,373,314 | A | | 2/1983 | Allan | 52/434 |
| 4,473,984 | A | | 10/1984 | Lopez | 52/410 |
| 4,756,136 | A | * | 7/1988 | Hodges | 52/687 |
| 4,852,320 | A | * | 8/1989 | Ballantyne | 52/562 |
| 4,869,038 | A | | 9/1989 | Catani | 52/712 |
| 4,875,319 | A | | 10/1989 | Hohmann | 52/383 |
| 5,392,581 | A | | 2/1995 | Hatzinikolas et al. | 52/712 |

(Continued)

FOREIGN PATENT DOCUMENTS

DE 3504689 * 8/1986

OTHER PUBLICATIONS

Building Envelope Requirements, 780 CMR§1304.0 et seq. of Chapter 13; Boston, MA, Jan. 1, 2001.

(Continued)

*Primary Examiner*—Winnie Yip
(74) *Attorney, Agent, or Firm*—Siegmar Silber

(57) ABSTRACT

A high-span anchoring system is described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall. The compressively reduced in height wall anchors protrude into the cavity through the seams, between insulation strips, which seams seal thereabout and maintain the integrity of the insulation by minimizing air leakage. Further, the eye wires extend across the insulation into the cavity between the wythes, and each accommodates the threading thereinto of a wire facing anchor or wall tie with either a pintle inserted through the eye or the open end of the veneer tie. The veneer tie is then positioned so that the insertion end is embedded in the facing wall. The close control of overall heights permits the mortar of the bed joints to flow over and about the wall reinforcement and wall tie combination inserted in the inner wythe and insertion end of the wall in the outer wythe. Because the wire formatives hereof employ extra strong material and benefit from the cold-working of the metal alloys, the high-span anchoring system meets the unusual requirements demanded thereof.

8 Claims, 9 Drawing Sheets

U.S. PATENT DOCUMENTS

| | | | | | |
|---|---|---|---|---|---|
| 5,408,798 | A | | 4/1995 | Hohmann | 52/562 |
| 5,454,200 | A | * | 10/1995 | Hohmann | 52/513 |
| 5,456,052 | A | | 10/1995 | Anderson et al. | 52/379 |
| 5,490,366 | A | * | 2/1996 | Burns et al. | 52/713 |
| 5,634,310 | A | * | 6/1997 | Hohmann | 52/513 |
| 5,816,008 | A | | 10/1998 | Hohmann | 52/565 |
| 5,845,455 | A | * | 12/1998 | Johnson, III | 52/713 |
| 6,209,281 | B1 | | 4/2001 | Rice | 52/379 |
| 6,279,283 | B1 | | 8/2001 | Hohmann et al. | 52/379 |

OTHER PUBLICATIONS

Cantini, Mario J.; Heavy Duty Joint Reinforcement, *Masonry*, Apr. 1995.

Lochonic, K. et al; Wall Reinforcing Design, *The Story Pole*, Aug. 2001.

Dur-O-Wal, Inc., Product Catalog (Aurora, II; 2000).

Wire Bond Corp,; Product Catalog (Charlotte, NC; 2002/2003).

Hohmann & Barnard, Inc.; Product Catalog (Hauppauge, NY; 2002).

ASTM Standard Specification for Masonry Joint Reinforcement; Designation A 951-00 (Approved Sep. 10, 2000; Published Oct. 2000).

Duro-Wal Tech Paper 93-1 (undated).

* cited by examiner

HIGH-SPAN ANCHORING SYSTEM FOR CAVITY WALLS

BACKGROUND OF THE INVENTION

1. Field of the Invention

This invention relates to an improved structure for cavity walls having larger-than-normal cavities therewithin, and, more particularly, to cavity walls requiring novel anchoring systems for spanning the cavity, which systems maintain the ability to meet existing wind shear and seismic specifications.

2. Description of the Prior Act

Recently, there have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜-inch-high space in the inner wythe and tie down a veneer facing material of an outer wythe at a span of two or more times that which had previously been experienced.

Exemplary of the public sector building specification is that of the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe.

Another application for high-span anchoring systems is in the evolving technology of self-cooling buildings. Here, the cavity wall serves additionally as a plenum for delivering air from one area to another. While this technology has not seen wide application in the United States, the ability to size cavities to match air moving requirements for naturally ventilated buildings enables the architectural engineer to now consider cavity walls when designing structures in this environmentally favorable form.

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. Thus, these contractors look towards substituting thinner gage wire formatives which result in easier alignment of courses of block.

In the past, there have been investigations relating to the effects of various forces, particularly lateral forces, upon brick veneer construction having wire formative anchors embedded in the mortar joint of anchored veneer walls. The seismic aspect of these investigations were referenced in the first-named inventor's prior patents, namely, U.S. Pat. Nos. 4,875,319 and 5,408,798. Besides earthquake protection, the failure of several high-rise buildings to withstand wind and other lateral forces has resulted in the incorporation of a requirement for continuous wire reinforcement in the Uniform Building Code provisions. The first-named inventor's related Seismiclip$^R$ and DW-10-X$^R$ products (manufactured by Hohmann & Barnard, Inc., Hauppauge, N.Y. 11788) have become widely accepted in the industry. The use of a wire formative anchors in masonry veneer walls has also demonstrated protectiveness against problems arising from thermal expansion and contraction and has improved the uniformity of the distribution of lateral forces in a structure. However, these investigations do not address the mortar layer thickness vs. the wire diameter of the wire formative or technical problems arising therefrom.

In the course of preparing this disclosure several patents became known to the inventors hereof. The following patents are believed to be relevant and are discussed further as to the significance thereof:

| U.S. Pat. No. | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 2, 1984 |
| 4,869,038 | Catani | Sep. 26, 1989 |
| 4,875,319 | Hohmann | Oct. 24, 1989 |
| 5,392,581 | Hatzinikolas et al. | Feb. 28, 1995 |
| 5,408,798 | Hohmann | Apr. 25, 1995 |
| 5,456,052 | Anderson et al. | Oct. 10, 1995 |
| 5,816,008 | Hohmann | Oct. 15, 1998 |
| 6,209,281 | Rice | Apr. 3, 2001 |
| 6,279,283 | Hohmann et al. | Aug. 28, 2001 |

It is noted that with some exceptions these devices are generally descriptive of wire-to-wire anchors and wall ties and have various cooperative functional relationships with straight wire runs embedded in the interior and/or exterior wythe. Several of the prior art items are of the pintle and eyelet/loop variety.

U.S. Pat. No. 3,377,764—D. Storch—Issued Apr. 16, 1968

Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977

Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued 09/26/89

Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989

Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,392,581—Hatzinikolas et al.—Issued Feb. 28, 1995

Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995

Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995

Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 15, 1998

Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,209,281—Rice—Issued Apr. 3, 2001

Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001

Discloses a low-profile wall tie primarily for use in renovation construction where in order to match existing mortar height in the facing wythe a compressed wall tie is embedded in the bed joint of the brick veneer.

None of the above provide the masonry cavity wall construction system for an inner masonry wythe and an outer facing wythe with high-span anchoring wire formatives as described hereinbelow.

SUMMARY

In general terms, the invention disclosed hereby includes a high-span anchoring system for a cavity wall incorporating a wall reinforcement combined with a wall tie for serving a wall construct having an inner wythe and an outer wythe. The wythes are in a spaced apart relationship and form a larger-than-normal cavity therebetween. In the embodiments disclosed, a unique combination of a wall reinforcement and a wall tie member is provided. The invention contemplates that the primary components of the system are structured from reinforcing wire and wire formatives, such as truss reinforcement or ladder mesh reinforcements, and provide wire-to-wire connections therebetween. Further, the various embodiments combine wire formatives which are compressively reduced in height by the cold-working thereof.

The embodiments of the invention disclosed hereby include a veneer anchoring system incorporating a low-profile wall tie for use in the construction of a wall having an inner wythe with thick strips of insulation attached thereto. The seams between the strips of insulation are coplanar with the inner wythe bed joints. The compressively reduced in height wall anchors protrude into the cavity through the seams, which seams seal thereabout so as to maintain the integrity of the insulation and minimize air leakage along the wall anchors. The invention contemplates that some components of the system are as described in U.S. Pat. Nos. 5,408,798; 5,454,200; and 6,279,283 and that the wire formatives hereof provide a positive interlocking connection therebetween specific for the requirements created by this high-span application.

In the mode of practicing the invention, wherein the inner wythe is constructed from a masonry block material, the masonry anchor has, for example, a truss portion with eye wire extensions welded thereto. The eye wires extend across the insulation into the cavity between the wythes. Each of the eye wires accommodates the threading thereinto of a wire facing anchor or wall tie with either a pintle inserted through the eye or the open end of the wall tie. The wall tie is then positioned so that the insertion end is embedded in the facing wall. The masonry anchor is embedded in a bed joint of the interior wythe. Wall ties compressively reduced in height are described as being mounted in bed joints of the inner and outer wythes. The close control of overall heights permits the mortar of the bed joints to flow over and about the wall reinforcement and wall tie combination inserted in the inner wythe and insertion end of the wall in the outer wythe. Because the wire formatives hereof employ extra strong material and benefit from the cold-working of the metal alloys, the high-span anchoring system meets the unusual requirements demanded.

OBJECTS AND FEATURES OF THE INVENTION

It is an object of the present invention to provide in a wall structure having a larger-than-normal cavity formed by a outer wythe and an inner wythe, a high-span anchoring system which employs low-profile wire formatives in the mortar joint of the inner wythe and is positively interconnected with a veneer tie inserted into the outer wythe.

It is another object of the present invention to provide labor-saving devices to aid in the installation of heavily insulated cavity wall structures and provide for the securement of facing veneers.

It is yet another object of the present invention to provide a high-strength, low-profile anchoring system which utilizes high cross-sectional area components for wall reinforcement of the inner wythe in a manner such that the mortar layer thickness thereof is readily maintainable.

It is a further object of the present invention to provide a high-span anchoring system comprising a limited number of component parts that are economical of manufacture resulting in a relatively low unit cost.

It is yet another object of the present invention to provide a high-span anchoring system which is easy to install and which meets seismic and sheer resistance requirements.

It is a feature of the present invention that the portion of the wall tie embedded in the bed joint of the inner wythe has a pattern impressed thereon.

It is another feature of the present invention that the veneer tie, the wall tie and the combined wall tie and wall reinforcement are dimensioned with a sufficiently low profiles so that, when inserted into the respective mortar layers, the mortar thereof can flow around and onto the low-profile wall tie.

It is yet another feature of the present invention that a flattened portion of the wall tie spans the insulation of the cavity wall at the seam thereof and that the insulation sealingly surrounds the wall tie.

Other objects and features of the invention will become apparent upon review of the drawing and the detailed description which follows.

BRIEF DESCRIPTION OF THE DRAWING

In the following drawings, the same parts in the various views are afforded the same reference designators.

DESCRIPTION OF THE PREFERRED EMBODIMENTS

Figure 1:
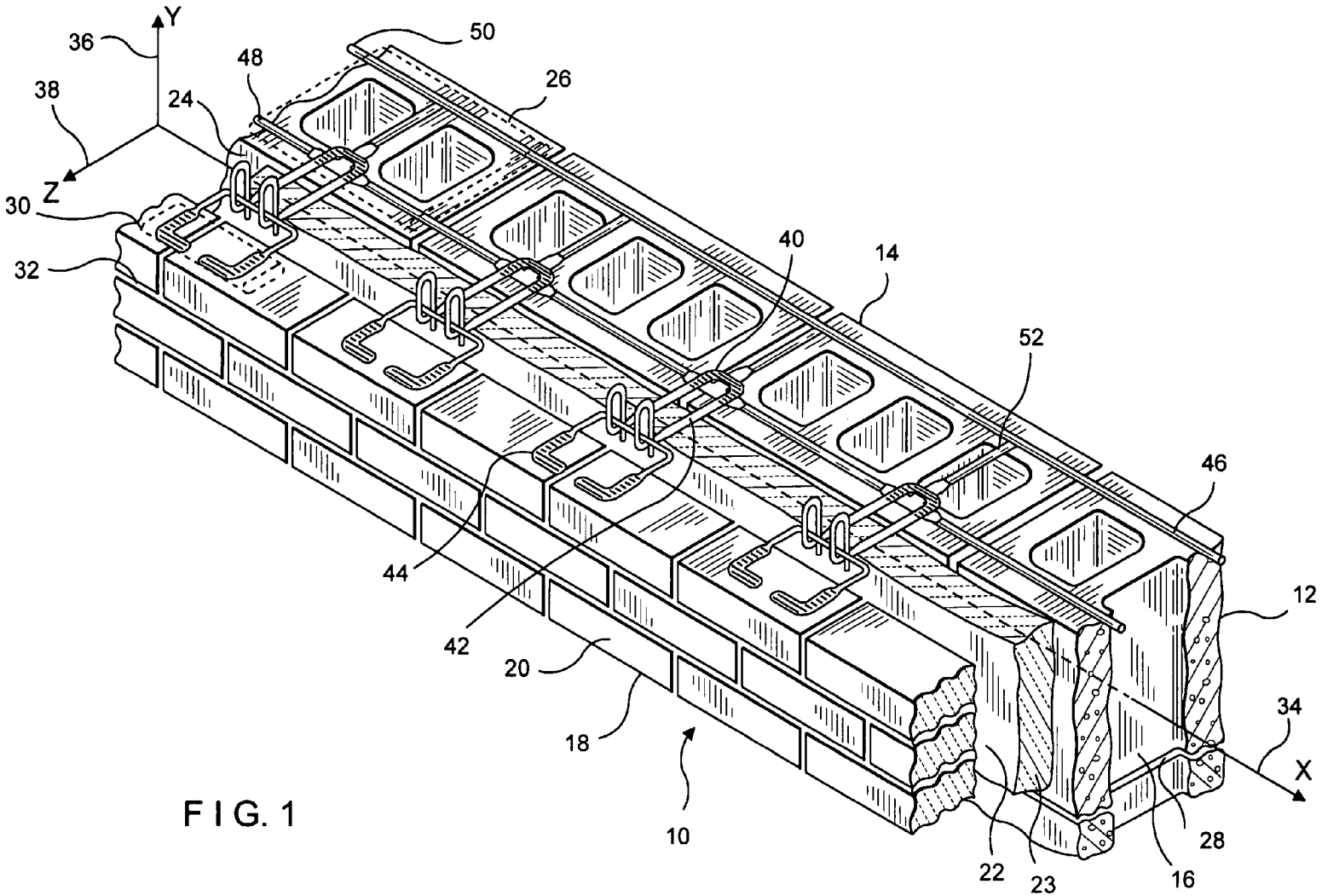
FIG. 1 is a perspective view of a first embodiment of a high-span anchoring system for a cavity, wall of this invention and shows a wall having a larger-than-normal cavity with an inner wythe of masonry block insulation on said inner wythe and an outer wythe of brick.

Before entering into the detailed Description of the Preferred Embodiments, several terms are defined, which terms will be revisited later, when some relevant analytical issues are discussed. For the purposes of this disclosure a cavity wall with a larger-than-normal or high-span cavity is defined as a wall in which the exterior surface of the inner wythe is spaced from the interior surface of the outer wythe by more than four inches (as measured along a line normal to the surfaces). When such high-span cavities occur, the effect is that stronger joint reinforcements are required in the inner wythe to support the stresses imparted by anchoring the more distant outer wythe or brick veneer. As described hereinbelow, this is accomplished while still maintaining building code requirements for masonry structures, including the mortar bed joint height specification of 0.375 inches. Although thicker gage wire formatives are required for greater strength, it is still preferable to have some of the bed joint mortar covering the wall anchor structure. Thus, in practical terms, the optimal height of the assemblage inserted into the bed joint of the outer wythe is approximately 0.300 inches.

Another term defined for purposes of this application is wall reinforcement. A wall reinforcement is a continuous length of Lox All® Truss Mesh or Lox All® Ladder Mesh manufactured by Hohmann & Barnard, Inc., Hauppauge, N.Y. 11788 or equivalent adapted for embedment into the horizontal mortar joints of masonry walls. The wall reinforcements are prefabricated from cold-drawn steel wire and have parallel side rods with butt welded cross rods or truss components. The wall reinforcements for high-span anchoring systems are generally structured from wire that is at least 3/16-inch in diameter.

Referring now to FIGS. 1 through 4, the first embodiment of a high-span anchoring system for a cavity wall is now discussed in detail. For the first embodiment, a cavity wall having an insulative layer of 3½ inches (approx.) and a total span of 6 inches (approx.) is chosen as exemplary. This structure meets the R-factor requirements of the public sector building specification, see supra. The high-span anchoring system is referred to generally by the numeral 10. A cavity wall structure 12 is shown having an inner wythe 14 of masonry blocks 16 and an outer wythe 18 of facing brick 20. Between the inner wythe 14 and the outer wythe 18, a cavity 22 is formed.

The cavity 22 is insulated with strips of insulation 23 attached to the exterior surface 24 of the inner wythe 14 and having seams 25 between adjacent strips 23 coplanar with adjacent bed joints 26 and 28. The cavity 22 is larger-than-normal and has a 6-inch span. Successive bed joints 26 and 28 are formed between courses of blocks 16. The bed joints 26 and 28 are substantially planar and horizontally disposed and in accord with building standards are 0.375-inch (approx.) in height. Also, successive bed joints 30 and 32 are formed between courses of bricks 20 and the joints are substantially planar and horizontally disposed. Selected bed joint 26 and bed joint 30 are constructed to be interconnected utilizing the construct hereof; however, in this embodiment, the joints 26 and 30 are unaligned.

For purposes of discussion, the cavity surface 24 of the inner wythe 14 contains a horizontal line or x-axis 34 and an intersecting vertical line or y-axis 36. A horizontal line or z-axis 38 also passes through the coordinate origin formed by the intersecting x- and y-axes. A wall anchor 40 is shown which has an insulation-spanning portion 42. Wall anchor 40 is a wire formative tie which is constructed for embedment in bed joint 26 and an interconnecting veneer tie 44.

The masonry or wall anchor 40 is adapted from one shown and described in Hohmann, U.S. Pat. No. 5,454,200, which patent is incorporated herein by reference. The wall anchor 40 is shown in FIG. 1 as being emplaced on a course of blocks 16 in preparation for embedment in the mortar of bed joint 26. In this embodiment, the system includes a ladder-type wall reinforcement 46, a wall anchor 40 and a veneer tie 44. The wall reinforcement 46 is constructed of a wire formative with two parallel continuous straight, side wires 48 and 50 spaced so as, upon installation, to each be centered along the outer walls of the masonry blocks 16. An intermediate wire body or a plurality of cross rods 52 are interposed therebetween and connect wire members 48 and 50 forming rung-like portions of the ladder-type reinforcement 46.

At intervals along the ladder-type reinforcement 46, spaced pairs of transverse wire members 54 are attached thereto and are attached to each other by a rear leg 56 therebetween. These pairs of wire members 54 extend into the cavity 22. The spacing therebetween limits the x-axis movement of the construct. Each transverse wire member 54 has at the end opposite the attachment end, an eye wire portion 58 formed continuous therewith. Upon installation, the eye 60 of eye wire portion 58 is constructed to be within a substantially vertical plane normal to exterior surface 24. The eye 60 is elongated vertically in both directions to accept a veneer tie threadedly therethrough from the unaligned bed joint. The eye 60 is slightly larger horizontally than the diameter of the tie. This dimensional relationship minimizes the z-axis movement of the construct. For positive interengagement, the eye 60 of eye wire portion 58 is sealed forming a closed loop.

Figure 2:
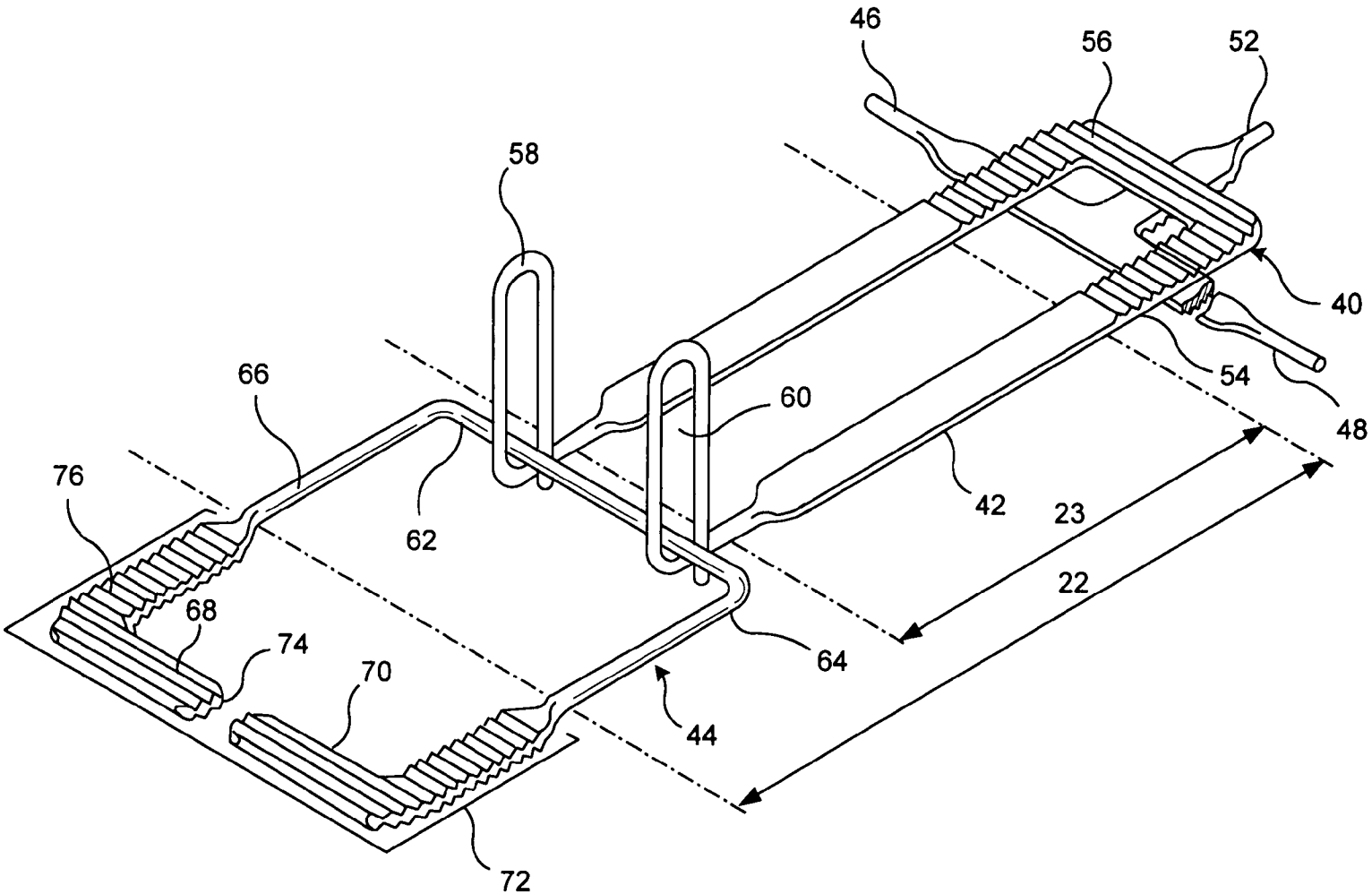
FIG. 2 is a partial perspective view of FIG. 1 showing a portion of the wall reinforcement; the high-strength, extended wall anchor; and, the interlocking, low-profile wall tie.

The wall tie or box tie 44 FIG. 2, is, when viewed from a top or bottom elevation, generally rectangular in shape and is a basically planar body. The box wall tie 44 is dimensioned to be accommodated by a pair of eye wire portions 58 described, supra. The wall tie 44 has a rear leg portion 62, two parallel side leg portions 64 and 66, which are contiguous and attached to the rear leg portion 62 at one end thereof, and two parallel front leg portions 68 and 70. To facilitate installation, the front leg portions 68 and 70 are spaced apart at least by the diameter of the eye wire member 58. The longitudinal axes of leg portions 66 and 68 and the longitudinal axes of the contiguous portions of the side leg portions 64 and 66 are substantially coplanar. The side leg portions 64 and 66 are structured to function cooperatively with the spacing of transverse wire members 54 to limit the x-axis movement of the construct. The box tie 44 is constructed so that with insertion through eye 60, the misalignment tolerated is approximately one-half the vertical spacing between adjacent bed joints of the facing brick course. As will be described in more detail hereinbelow, the insertion portion 72 of veneer tie 44 is considerably compressed with the vertical height 74 being reduced. Upon compression, a pattern or corrugation 76 is impressed.

For high-span applications, the above-described arrangement of wire formatives has been strengthened in several ways. First, in place of the standard 9-gage (0.148-inch diameter) wall reinforcement wire, a 3/16-inch (0.187-inch diameter) wire is used. Additionally a 0.250-inch wire is used to form both the wall anchor 40 and the veneer anchor 44. To approximate the 0.300-inch optimal height, see supra, the insertion ends of both anchors 40 and 44 and the corresponding attachment site at cross rod 52 are compressively reduced in height. In this regard, side rod 48 and cross rod 52 are reduced to 68% to a height of 0.130-inch; and the anchors 68%, to a height of 0.170-inch. Although in this example to compressively size the components the same reduction is used, the components are selectively compressible. By way of further example, when the wall reinforcement at 0.187-inch is not reduced in height, the corresponding wall anchor may be reduced to 46% to meet the 0.300-inch optimal height. As a general rule, compressive reductions up to 75% are utilized and high-span strength calculations are based thereon.

Figure 3:
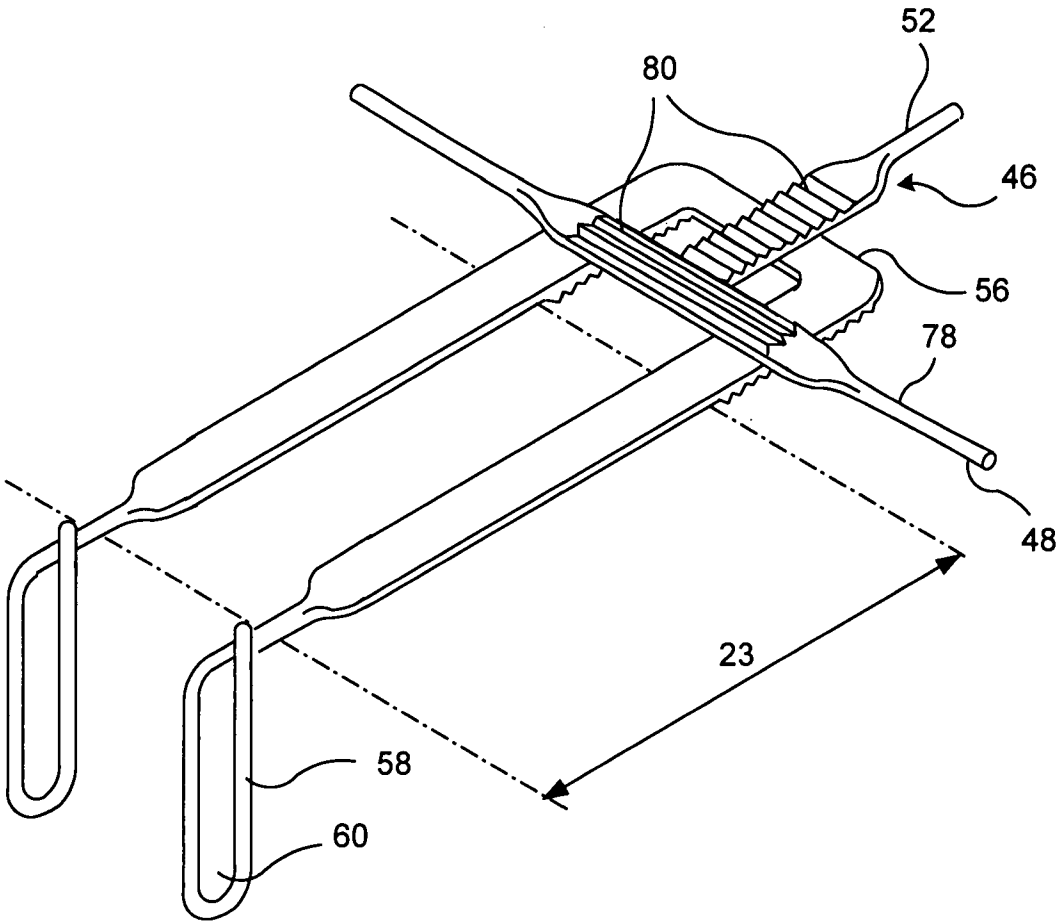
FIG. 3 is a partial perspective view from below of the wall reinforcement of FIG. 2 showing the corrugated pattern thereof.

As described in a prior patent of the present inventors, namely, Hohmann et al., U.S. Pat. No. 6,279,283, the insertion ends of the wall anchor is, upon cold-forming, optionally impressed with a pattern on the mortar-contacting surfaces. For this application, while several patterns—corrugated, diamond and cellular—are discussed in the patent, only the corrugated pattern is employed. The ridges and valleys of the corrugations are shown in FIGS. 1 and 2 and are impressed so that, upon installation, the corrugations are parallel to the x-axis. In FIG. 3, the lower surface of wall reinforcement 46 is shown having corrugations 78 impressed on side rod 48 and corrugations 80 impressed on cross rods 52.

Figure 4:
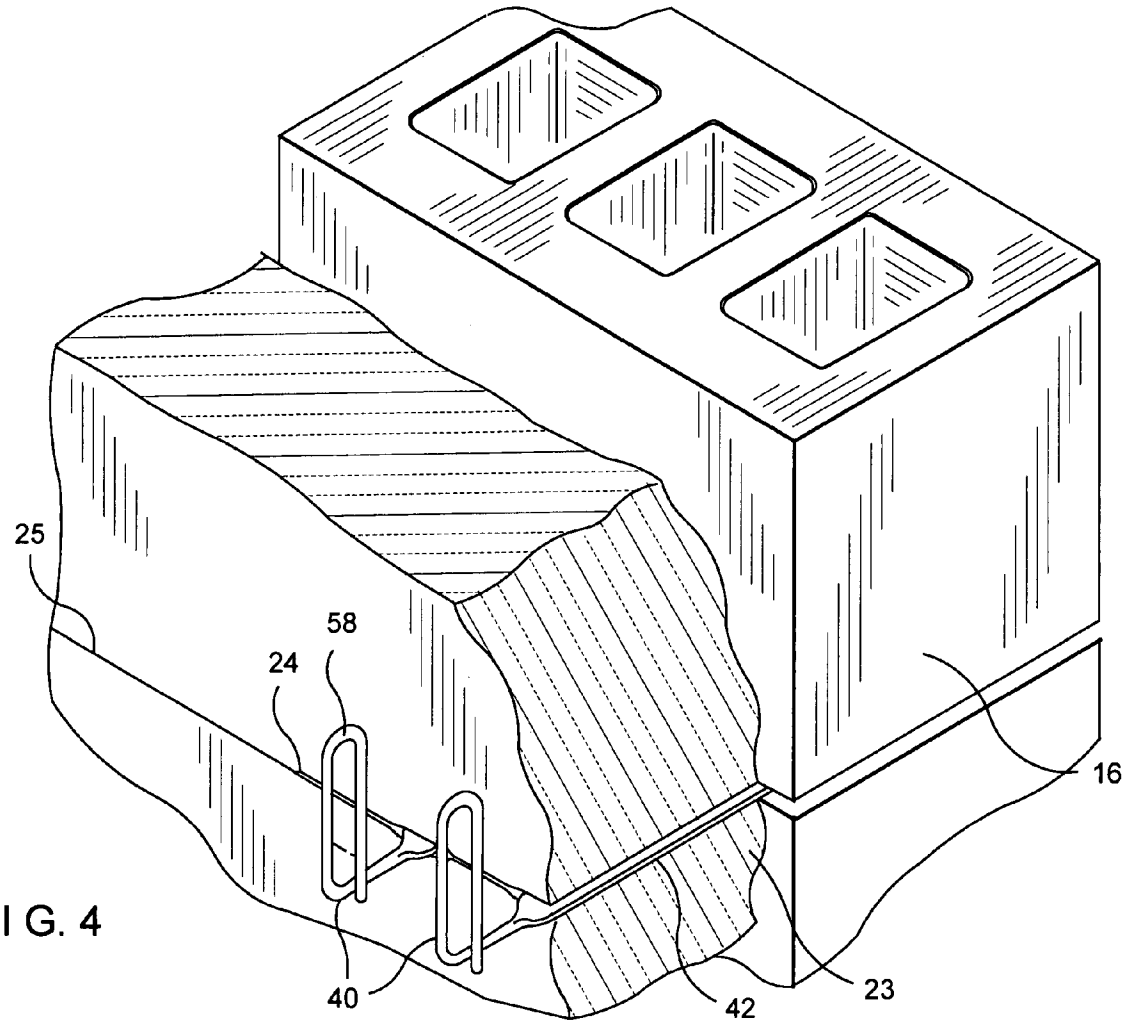
FIG. 4 is a partial perspective view of the insulation sealing about and against the insulation-spanning portion of the wall anchor of FIG. 2.

The high-span cavity, as previously mentioned, results from a requirement of a thick, high R-factor insulation layer 23 which is shown in FIG. 4. The successive insulation strips 23 when in an abutting relationship the one with the other are sufficiently resilient to seal at seam 25 without air leakage therebetween. The extended insulation-spanning portions 42 of wall anchor 40 are flattened. This results in minimal interference with seal at seam 25.

Figure 5:
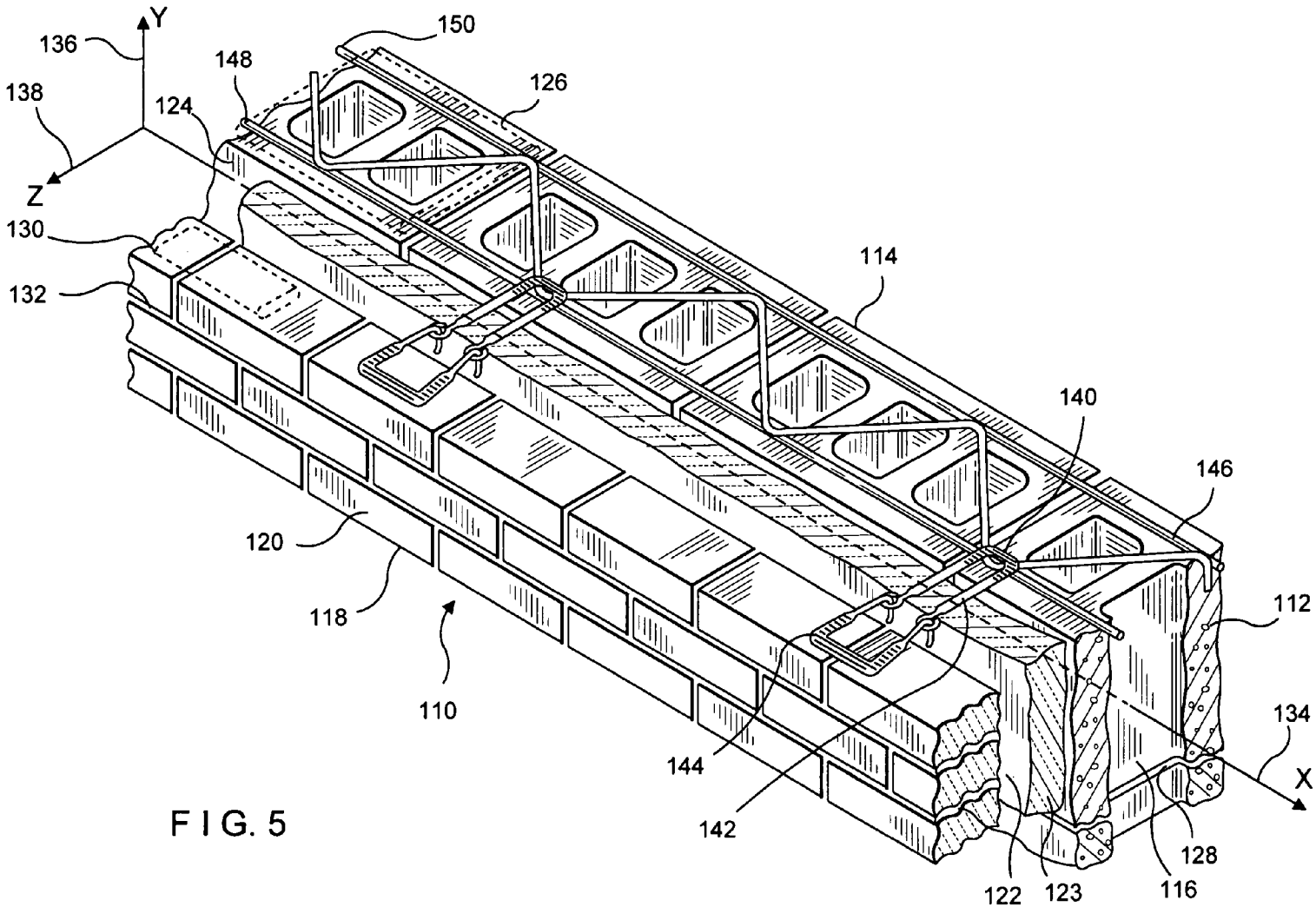
FIG. 5 is a perspective view of a second embodiment of a high-span anchoring system for a cavity wall, similar to FIG. 1, but employing a truss mesh reinforcement in the inner wythe and a rectangular pintle wall tie in the outer wythe.
Figure 6:
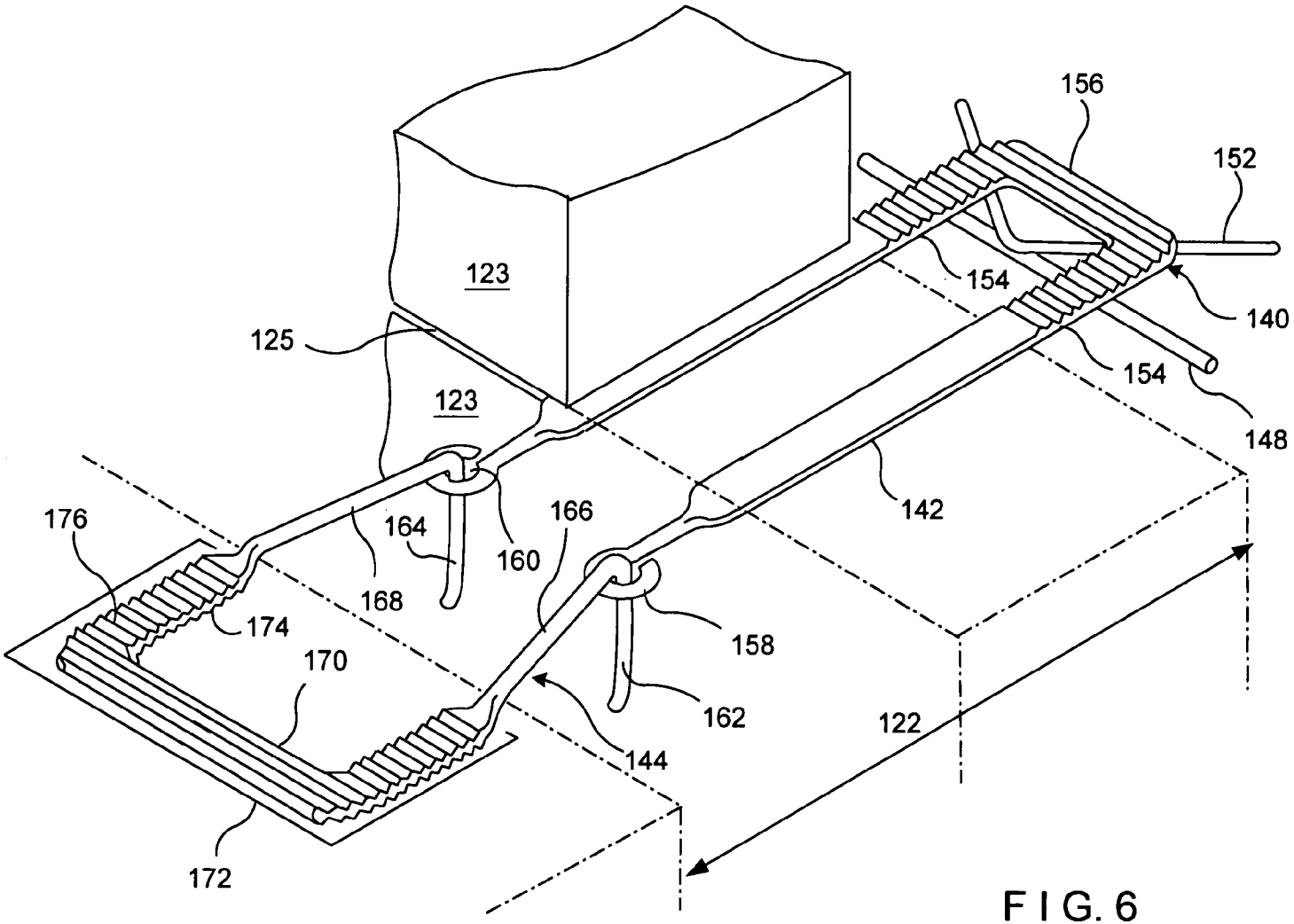
FIG. 6 is a partial perspective view of FIG. 5 showing a portion of the compressed wall anchor and the interlocking wall tie.

The description which follows is of a second embodiment of the high-span anchoring system of this invention. For ease of comprehension, where similar parts are used reference designators "100" units higher are employed. Thus, the veneer tie 144 of the second embodiment is analogous to the veneer tie 44 of the first embodiment. Referring now to FIGS. 5 and 6, the second embodiment of a high-span anchoring system of this invention is shown and is referred to generally by the numeral 110. As in the first embodiment, a wall structure 112 is shown having an inner wythe 114 of masonry blocks 116 and an outer wythe 118 of facing brick 120. Between the inner wythe 114 and the outer wythe 118, a cavity 122 is formed.

The cavity 122 is insulated with strips of insulation 123 attached to the exterior surface 124 of the inner wythe 114 and having seams 125 between adjacent strips coplanar with adjacent bed joint 126. The cavity 122 is larger-than-normal and has a 5-inch span. Successive bed joints 126 and 128 are formed between courses of blocks 116 and the joints are substantially planar and horizontally disposed. Also, successive bed joints 130 and 132 are formed between courses of bricks 120 and the joints are substantially planar and horizontally disposed. Selected bed joint 126 and bed joint 130 are constructed to be interconnected utilizing the construct hereof; however, the joints 126 and 130 are unaligned.

For purposes of discussion, the exterior surface 124 of the interior wythe 114 contains a horizontal line or x-axis 134 and an intersecting vertical line or y-axis 136. A horizontal line or z-axis 138 normal to the xy-plane also passes through the coordinate origin formed by the intersecting x- and y-axes.

The wall anchor 140 is shown in FIG. 6 as having an insulation-spanning portion or extension 142 for interconnection with veneer tie 144 and further is shown as being emplaced on a course of blocks 116 in preparation for embedment in the mortar of bed joint 126. In this embodiment, a truss-type wall reinforcement 146 is constructed of a wire formative with two parallel continuous straight side wire members 148 and 150 spaced so as, upon installation, to each be centered along the outer walls of the masonry blocks 116. An intermediate wire body 152 is interposed therebetween and connect wire members 148 and 150 separating and connecting side wires 148 and 150 reinforcement 146.

At intervals along the truss-type reinforcement 146, spaced pairs of transverse wire members 154 are attached thereto and are attached to each other by a rear leg 156 therebetween. These pairs of wire members 154 extend into the cavity 122. Each transverse wire member 154 has at the end opposite the attachment end an eye wire portion 158 formed continuous therewith. Upon installation, the eyes 160 of eye wire portion 158 are constructed to be within a substantially horizontal plane normal to exterior surface 124. The eyes 160 are horizontally aligned to accept the pintles of a veneer tie 144 threaded therethrough from the unaligned bed joint. The eyes 160 are slightly larger than the diameter of the pintles, which dimensional relationships minimize the x- and z-axis movement of the construct. For ensuring engagement, the pintles of veneer tie member 144 are available in a variety of lengths.

The low-profile veneer tie or wire formative wall tie 144 is, when viewed from a top or bottom elevation, generally U-shaped. The low-profile wall tie 144 is dimensioned to be accommodated by a pair of eye wire portions 158 described, supra. The wall tie 144 has two rear leg portions or pintles 162 and 164, two parallel side leg portions 166 and 168, which are substantially at right angles and attached to the rear leg portions 162 and 164, respectively, and a front leg portion 170. An insertion portion 172 of veneer tie 144, upon installation extends beyond the cavity 122 into bed joint 130, which portion includes front leg portion 170 and part of side leg portions 166 and 168. The longitudinal axes of side leg portions 166 and 168 and the longitudinal axis of the front leg portion 170 are substantially coplanar.

In the second embodiment and for the high-span applications, the above-described arrangement of wire formatives has been strengthened in several respects. First, in place of the standard 9-gage (0.148-inch diameter) wall reinforcement wire, a 3/16-inch (0.187-inch diameter) wire is used. Additionally a 0.250-inch wire is used to form both the wall anchor 40 and the veneer anchor 144. In contradistinction to the first embodiment to approximate the 0.300-inch optimal height, see supra, the insertion ends of only anchors 140 and 144 are compressively reduced in height. In this regard, wall anchor 140 is reduced by 50% to a height of 0.125-inch; and veneer tie 144 by 68%, to a height of 0.170-inch. Also and similar to the first embodiment, the successive insulation strips 123 when in an abutting relationship the one with the other are sufficiently resilient to seal at seam 125 without air leakage therebetween. The extended insulation-spanning portions 142 of wall anchor 140 are flattened. This results in minimal interference with seal at seam 125.

Upon compressing the insertion ends of wall anchors 140 and 144, a corrugated pattern is optionally impressed thereon. The ridges and valleys of the corrugations 176 are shown in FIGS. 5 and 6 and are impressed so that, upon installation, the corrugations 176 are parallel to the x-axis 134.

The insertion portion 172 of veneer tie 144 is considerably compressed and, while maintaining the same mass of material per linear unit as the adjacent wire formative, the vertical height 174 is reduced. The vertical height 174 of insertion portion 172 is reduced so that, upon installation, mortar of bed joint 130 flows around the insertion portion 172. Upon compression, a pattern or corrugation 176 is impressed on either or both of the upper and lower surfaces of insertion portion 172. When the mortar of bed joint 128 flows around the insertion portion, the mortar flows into the valleys of the corrugations 176. The corrugations enhance the mounting strength of the veneer tie 144 and resist force vectors along the z-axis 138. With wall tie 144 compressed as described, the wall tie is characterized by maintaining substantially all the tensile strength as prior to compression.

The description which follows is of a third embodiment of the high-span anchoring system of this invention. For ease of comprehension, where similar parts are used reference designators "200" units higher are employed. Thus, the wall anchor 240 of the third embodiment is analogous to the wall anchor 40 of the first embodiment. The veneer anchor of this embodiment is adapted from that shown in U.S. Pat. No. 5,454,200 to R. P. Hohmann.

Figure 7:
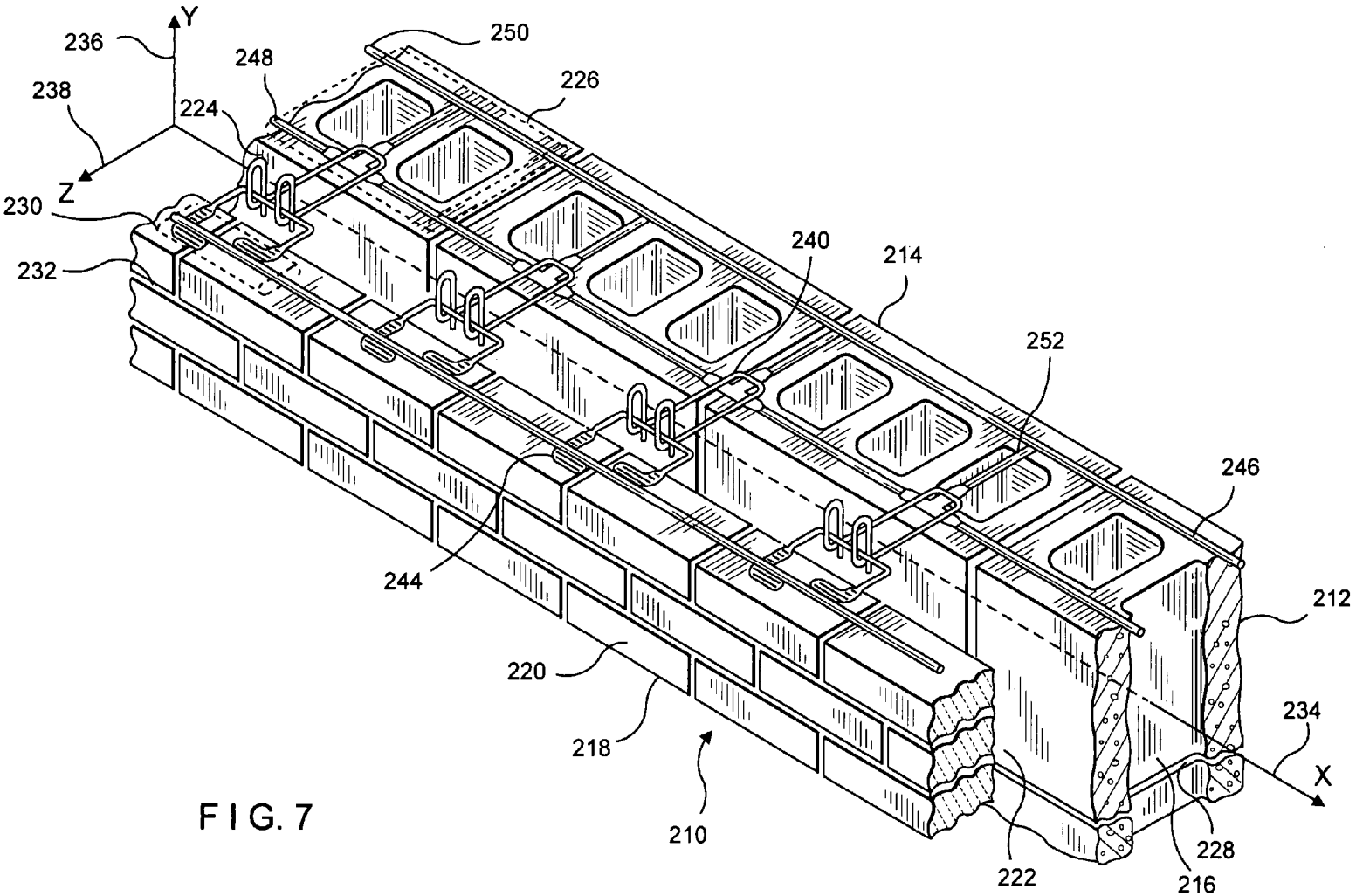
FIG. 7 is a perspective view of a third embodiment of a high-span anchoring system for a cavity wall similar to FIG. 1, but employing a compressed truss mesh wall reinforcement in the inner wythe, a wall anchor with elongated vertical eyes, and a veneer box-type anchor swayed to accept continuous wire.
Figure 8:
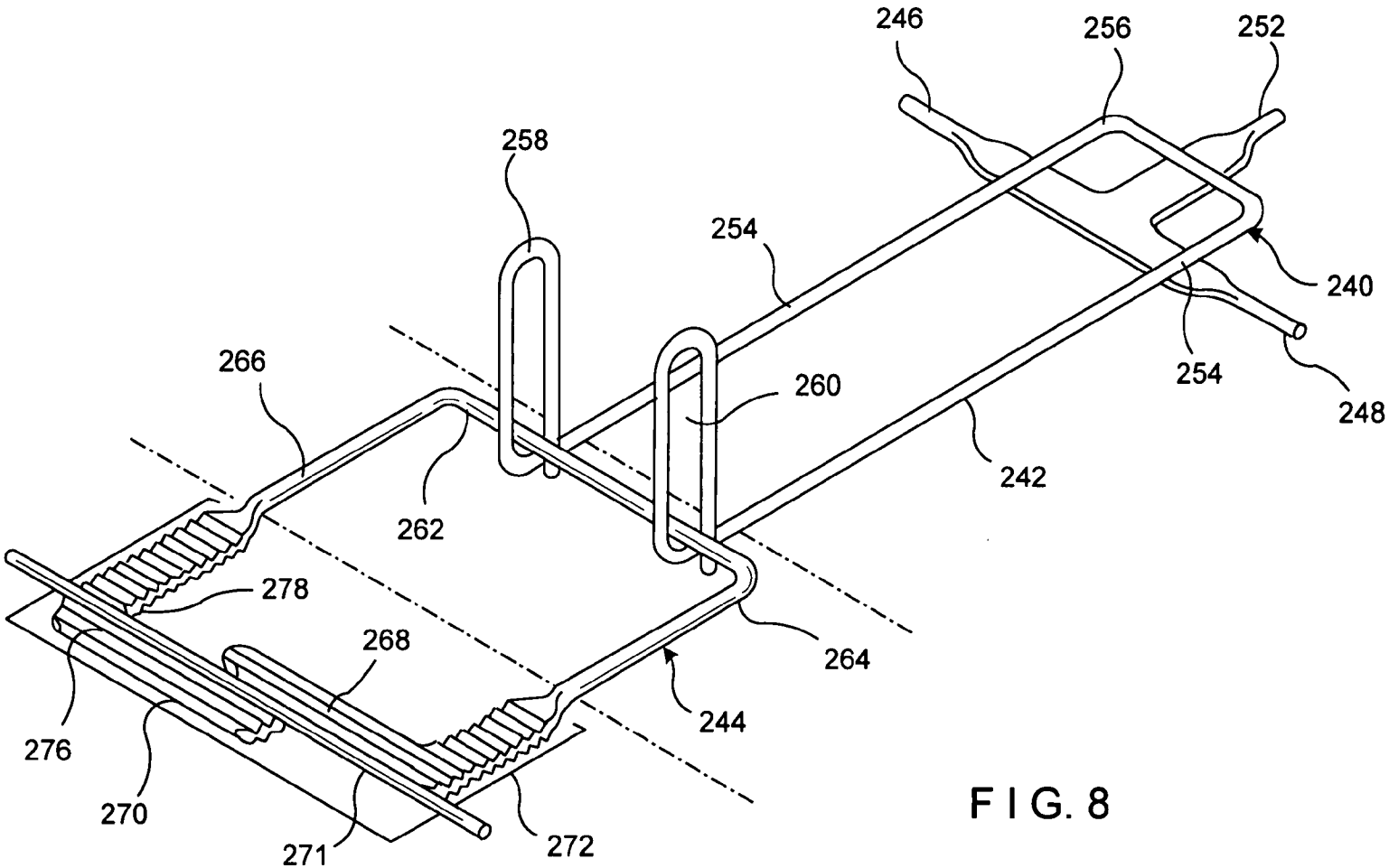
FIG. 8 is a partial perspective view of the wall anchor and veneer box-type anchor of FIG. 7 showing details of the compression of the wall anchor extension; and, FIG. 9 is a cross-sectional view of cold-worked wire used in the wire formatives hereof showing resultant aspects of continued compression.

Referring now to FIGS. 7 and 8, the third embodiment of a high-span anchoring system of this invention is shown and is referred to generally by the numeral 210. In this embodiment, a wall structure 212 is shown having an inner wythe 214 of masonry blocks 216 and an outer wythe 218 of facing brick 220. Between the inner wythe 214 and the outer wythe 218, a cavity 222 is formed, which cavity 222 has an exterior surface 224. In the third embodiment, successive bed joints 226 and 228 are formed between courses of blocks 216 and the joints are substantially planar and horizontally disposed. Also, successive bed joints 230 and 232 are formed between courses of bricks 220 and the joints are substantially planar and horizontally disposed. For each structure, the bed joints 226, 228, 230 and 232 are specified as to the height or thickness of the mortar layer and such thickness specification is rigorously adhered to so as to provide the uniformity inherent in quality construction. Selected bed joint 226 and bed joint 230 are constructed to align, that is to be substantially coplanar, the one with the other.

For purposes of discussion, the exterior surface 224 of the inner wythe 214 contains a horizontal line or x-axis 234 and an intersecting vertical line or y-axis 236. A horizontal line or z-axis 238 normal to the xy-plane also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the y-axis. The system 210 includes a masonry wall anchor 240 constructed for embedment in bed joint 226, which, in turn, includes a cavity-spanning or extension portion 242. Further, the system 210 includes a low-profile, wire formative veneer tie member 244 for embedment in bed joint 230.

The wall anchor 240 is shown in FIG. 7 as being emplaced on a course of blocks 216 in preparation for embedment in the mortar of bed joint 226. In the best mode of practicing the invention, a ladder-type wall reinforcement wire portion 246 is constructed of a wire formative with two parallel continuous straight wire members 248 and 250 spaced so as, upon installation, to each be centered along the outer walls of the masonry blocks 216. An intermediate wire bodies or cross rods 252 are interposed therebetween and connect wire members 248 and 250 forming rung-like portions of the ladder structure 246. At intervals along the wall reinforcement 246, spaced pairs of transverse wire members 254 are attached thereto and are attached to each other by a rear leg 256 therebetween. These pairs of wire members 254 are contiguous with extension portions 242 and extend across the cavity 222 to veneer tie 244. As will become clear by the description which follows, the spacing between the transverse wire member 254 is constructed to limit the x-axis movement of the construct. Each transverse wire member 254 has at the end opposite the attachment end an eye wire portion 258 formed continuous therewith.

Upon installation, the eye 260 of eye wire portion 258 is constructed to be within a substantially vertical plane normal to exterior surface 224. The eye 260 is dimensioned to accept a veneer tie threadedly therethrough and is thus slightly larger than the diameter of the tie. This relationship minimizes the z-axis movement of the construct. For positive engagement, the eye 260 of eye wire portion 258 is sealed forming a closed loop.

The veneer tie 244 is generally rectangular in shape and is dimensioned to be accommodated by a pair of eye wires 258 previously described. The wall tie 244 has a rear leg portion 262, two parallel side leg portions 264 and 266, and two front leg portions 268 and 270, which have been compressively reduced in height. The front leg portions 268 and 270 are spaced apart at least by the diameter of the veneer reinforcing wire member 271. An insertion portion 272 of wall tie 244, upon installation, extends beyond cavity 222 into bed joint 230, which portion includes front leg portions 268 and 270 and part of side leg portions 264 and 266 adjacent to front leg portions 268 and 270, respectively. The longitudinal axes of leg portions 262, 264, 266, 268 and 270 are substantially coplanar. The side leg portions 264 and 266 are structured to function cooperatively with the spacing of transverse wire members 254 to limit the x-axis movement of the construct.

The insertion portion 272 is considerably compressed and, while maintaining the same mass of material per linear unit as the adjacent wire formative, the vertical height 274 is reduced. The vertical height 274 of insertion portion 272 is reduced so that, upon installation, mortar of bed joint 230 flows around the insertion portion 272. Upon compression, a pattern or corrugation 276 is impressed on insertion portion 272 and, upon the mortar of bed joint 230 flowing around the insertion portion, the mortar flows into the corrugations 276. For enhanced holding, the corrugations 276 are, upon installation, substantially parallel to x-axis 234. In this embodiment, an indentation 278 is swaged into leg portion 266 opposite the opending between front leg portions 268 and 270, which indentation is dimensioned to accommodate veneer reinforcing wire 271. With the insertions end 272 of veneer tie 244 as described, the wall tie is characterized by maintaining substantially all the tensile strength as prior to compression while acquiring a desired low profile.

The third embodiment is for high-span applications in which larger-than-normal cavities occur, but for reasons other than increased insulation. The above-described arrangement of wire formatives has been strengthened in several ways. First, in place of the standard 9-gage (0.148-inch diameter) wall reinforcement wire, a 3/16-inch (0.187-inch diameter) wire is used throughout. Here, wall reinforcement 246, wall anchor 240, the veneer tie 244, and veneer reinforcing wire 271 are all formed from 0.187-inch diameter wire. In the inner wythe 214 to approximate the 0.300-inch optimal height the attachment site at cross rod 252 are compressively reduced in height. In this regard, side rod 248 and cross rod 252 are reduced to 60% of original height to a height of 0.113-inch. Additionally, the insertion end 272 of veneer tie 244 is reduced in height to 75% of original height to a height of 0.140-inch with the indentation 278 to a height of 0.110-inch. This enables the veneer reinforcing wire 271 to interlock with the veneer tie within the 0.300-inch tolerance. Although in this example compressive sizing is limited, the embodiment demonstrates the flexibility provided to architectural engineers by selectively compressing either or both the inner and outer wythe anchoring components.

Figure 9:
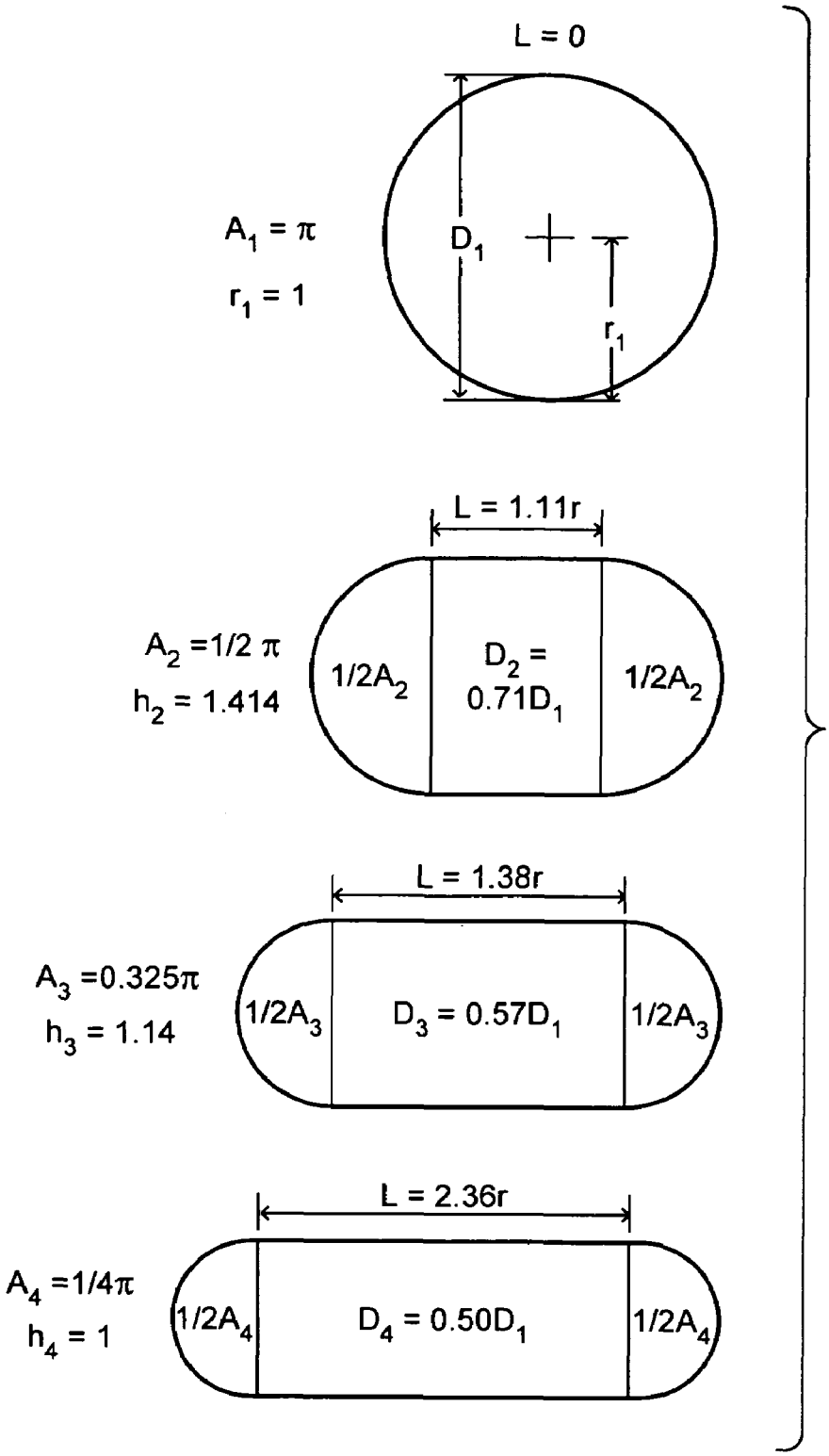

Analytically, wall anchor calculations entail viewing a weight hanging from the end of a beam. Here, the circular cross-section of a wire provides greater flexural strength than a sheetmetal counterpart. In the embodiments described herein the wire components of the wall anchors are cold-worked or partially flattened so that the above-referenced height specification is maintained and high-strength anchors are provided for the high-span cavities. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween, FIG. 9. The deformed body has substantially the same cross-sectional area as the original wire. In each example in FIG. 9, progressive deformation of a wire is shown. Disregarding elongation and noting the prior comments, the topmost portion shows the original wire having a radius, $r_1=1$; and area, $A_1=\Pi$; length of deformation, L=0; and a diameter, $D_1$. Upon successive deformations, the illustrations shows the area of circular cross-section being progressively ½, ⅜, and ¼ of the area, $A_1$, or $A_2=\frac{1}{2}\Pi$; $A_3=\frac{3}{8}\Pi$; and $A_4=\frac{1}{4}\Pi$, respectively. With the first deformation, the rectangular portion has a length L=1.11r (in terms of the initial radius of 1); a height, $h_2=1.14$; (or $D_2=0.71D_1$, where D=diameter); and therefore has an area of approximately $\frac{1}{2}\Pi$. Likewise, with the second deformation, the rectangular portion has a length, L=1.38r; a height, $h_3=1.14$; a diameter $D_3=0.57D_1$; and therefore has an area of approximately $\frac{5}{8}\Pi$. Yet again, with the third deformation, the rectangular portion has a length, L=2.36r; a height $h_4=1$; a diameter, $D_4=0.50D_1$; and therefore has an area of approximately $\frac{3}{4}\Pi$. From these estimation formulas, the degree of plastic deformation to remain at a 0.300 inch (approx.) combined height for the truss and wall tie can, as will be seen hereinbelow, be used to optimize the high-span anchoring system.

Turning once again to practical considerations, high-strength truss and ladder reinforcements for extra heavy applications utilize 9 gage—0.148 inch diameter—and 3/16 inch–0.187 inch diameter wires. In these applications, the 9-gage wire is used in the cross rods of the reinforcement with the 3/16-inch wire being used for the side rods and thereby filling 0.335 inch of the 0.375 bed joint space. Optimizing the added strength provided by the cold working of the metal alloy and using wire compression techniques, high-span anchoring systems are now able to utilize 0.187-inch diameter wire in the side rods and 0.250-inch diameter wire with compressive reduction in height up to 75%. This enables the stacked elements to have a combined height in the 0.300-inch range and thereby permits an adequate mortar coverage in the bed joint.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-span anchoring system for use in a wall having an inner wythe and an outer wythe in a spaced apart relationship the one with the other and informing a cavity in excess of four inches therebetween, said inner wythe formed from a plurality of successive courses with a bed joint of predetermined height between each two adjacent courses, said bed joint upon construction being filled with mortar, said high-span anchoring system having a wall reinforcement adapted for mounting in said inner wythe and further characterized by:

a wall anchor fixedly attached to said wall reinforcement and, in turn, comprising:

an insertion-end portion adapted for embedment in said bed joint of said inner wythe, said insertion-end portion compressively reduced in height up to 75% of the original height thereof;

an insulation-spanning portion extending from said insertion-end portion and adapted to extend toward said outer wythe, said insulation-spanning portion compressively reduced in height up to 75% of the original height thereof; and, a free-end portion of uncompressed wire attached to said insulation-spanning portion and, upon installation of said high-span anchoring system, adapted for disposition in said cavity of said wall.

2. A high-span anchoring system as described in claim 1, wherein said high-span anchoring system is further characterized by:

a veneer tie interengaging at one end thereof with a corresponding free-end portion of said wall anchor and at the other end thereof adapted for insertion into said outer wythe.

3. A high-span anchoring system as described in claim 1 wherein said wall anchor is a wire formative from a wire having a given mass and a diameter adapted to be substantially equal to said predetermined height of said mortar bed, said wire, upon being compressibly deformed, retaining the mass and substantially the tensile strength as prior to deformation.

4. A high-span anchoring system as described in claim 3, wherein said insertion-end portion of said wall anchor has an upper surface and a lower surface, said upper surface, upon being compressibly deformed, has a pattern of recessed areas impressed thereon adapted for receiving mortar therewithin and further adapted for enabling said bed joint to securely hold said wall tie.

5. A high-span anchoring system as described in claim 4, wherein said pattern is a corrugation with ridges and valleys.

6. A high-span anchoring system as described in claim 5, wherein said ridges of said corrugation are adapted, upon installation in said outer wythe, to be substantially parallel to the face plane thereof and further adapted by receiving mortar therewithin to increase the tie strength thereof.

7. In a high-span anchoring system for use in a wall having an inner wythe and an outer wythe in a spaced apart relationship the one with the other and informing a cavity in excess of four inches therebetween, said inner wythe formed from a plurality of successive courses with a bed joint of predetermined height between each two adjacent courses, said bed joint upon construction being filled with mortar, said high-span anchoring system comprising a wall reinforcement adapted for mounting in said bed joint of said inner wythe;

a plurality of wire formative ties attached at spaced intervals to said wall reinforcement, each of said wire formative ties having an attachment end adapted for disposition in said bed joint and a free end;

each of said wire formative ties, adapted upon installation in said inner wythe of said wall, to extend from said attachment end thereof toward said outer wythe and having said free end adapted for disposition in said cavity, wherein said wall reinforcement is characterized by:

a plurality of spaced attachment sites, each compressibly reduced in height and adapted for the attachment of one of said plurality of wire formative ties;

a veneer tie formed from a wire having a given mass and a diameter adapted to be substantially equal to said predetermined height of said mortar bed, said wire, upon being compressibly deformed, retaining the mass and substantially the tensile strength as prior to deformation, said insertion-end portion of said veneer tie has an upper surface and a lower surface, said upper surface, upon being compressibly deformed, has a pattern of recessed areas impressed thereon adapted for receiving mortar therewithin and further adapted for enabling said bed joint to securely hold said veneer tie;

whereby, upon each of said plurality of wire formative ties being mounted upon a corresponding one of said spaced attachment sites, the combined height is adapted to be substantially less than said predetermined height of said bed joint.

8. A high-span anchoring system as described in claim 7, wherein said pattern is a corrugation with ridges and valleys, said corrugation is adapted, upon installation in said outer wythe, to be substantially parallel to the face plane thereof and further adapted by receiving mortar therewithin to increase the tie strength thereof.

* * * * *